US006761281B2

(12) United States Patent
Hartman

(10) Patent No.: US 6,761,281 B2
(45) Date of Patent: Jul. 13, 2004

(54) MODIFIED SCORE FOR SMOOTH OPENABILITY

(75) Inventor: William H. Hartman, Barrington, IL (US)

(73) Assignee: Rexam Beverage Can Company, Chicago, IL (US)

( * ) Notice: Subject to any disclaimer, the term of this patent is extended or adjusted under 35 U.S.C. 154(b) by 60 days.

(21) Appl. No.: 10/304,243

(22) Filed: Nov. 26, 2002

(65) Prior Publication Data

US 2004/0099664 A1 May 27, 2004

(51) Int. Cl.[7] ..... B65D 17/34

(52) U.S. Cl. ..... 220/269; 220/906

(58) Field of Search ..... 220/269, 270, 220/271, 268, 266, 906

(56) References Cited

U.S. PATENT DOCUMENTS

| | | | |
|---|---|---|---|
| 3,291,336 | A | 12/1966 | Fraze |
| 3,411,470 | A | 11/1968 | Fraze |
| 3,424,337 | A | 1/1969 | Von Stocker |
| 3,563,199 | A | 2/1971 | Wolfe |
| 3,650,006 | A | 3/1972 | Kinkel |
| 3,687,099 | A | 8/1972 | Franek et al. |
| 3,688,718 | A | 9/1972 | Schrecker |
| 3,757,989 | A | 9/1973 | Brown |
| 3,836,038 | A | 9/1974 | Cudzik |
| 3,870,001 | A | 3/1975 | Brown |
| 3,912,114 | A | 10/1975 | Morran et al. |
| 3,938,455 | A | 2/1976 | Urmston |
| 3,946,683 | A | 3/1976 | Jordan |
| 3,949,692 | A | 4/1976 | DeLine et al. |
| 3,952,912 | A | 4/1976 | Perry |
| 3,954,075 | A | 5/1976 | Jordan |
| 3,967,752 | A | 7/1976 | Cudzik |
| 3,982,657 | A | 9/1976 | Keller et al. |
| 4,006,700 | A | 2/1977 | Lovell et al. |
| 4,015,744 | A | 4/1977 | Brown |
| 4,018,178 | A | 4/1977 | Klein et al. |
| 4,023,703 | A | 5/1977 | Strobe et al. |
| 4,024,981 | A | 5/1977 | Brown |
| 4,027,612 | A | 6/1977 | Herbst |
| 4,030,631 | A | 6/1977 | Brown |
| 4,061,243 | A | 12/1977 | Khoury |
| 4,084,721 | A | 4/1978 | Perry |
| 4,105,134 | A | 8/1978 | Debenham et al. |
| 4,122,791 | A | 10/1978 | Brown |
| 4,184,607 | A | 1/1980 | Potts |

(List continued on next page.)

FOREIGN PATENT DOCUMENTS

| | | | |
|---|---|---|---|
| EP | 0 564 725 | A1 | 10/1993 |
| EP | 0 704 382 | A2 | 4/1996 |
| GB | 563812 | | 8/1944 |
| JP | 57-199535 | A | 12/1982 |
| JP | 62-199237 | A | 9/1987 |
| JP | 1-308744 | | 12/1989 |
| JP | 6-024443 | | 2/1994 |
| JP | 8-244769 | | 9/1996 |

*Primary Examiner*—Jacob K. Ackun
(74) *Attorney, Agent, or Firm*—Wallenstein, Wagner & Rockey, Ltd.

(57) ABSTRACT

An ecology end member for a beverage container has a central panel wall with a product side, a public side, and an outer peripheral edge. A non-detachable tab is secured to the public side of the central panel wall by a rivet. A displaceable tear panel is located in the central panel wall adjacent the rivet. The tear panel is defined by a frangible score and a non-frangible hinge segment. The frangible score has a tear panel geometry with an outer periphery defied by a curvilinear score length. The tear panel geometry is asymmetrically skewed having a large radius of score curvature in a first outer quadrant of the tear panel to provide low resistance to opening the tear panel at the large radius. The tear panel has a radially outermost segment of the score located in a different quadrant of the tear panel.

20 Claims, 4 Drawing Sheets

U.S. PATENT DOCUMENTS 4,205,760 A 6/1980 Hasegawa
4,254,890 A 3/1981 Westphal
4,257,529 A 3/1981 Saunders
4,305,523 A 12/1981 Dalli et al.
4,320,850 A 3/1982 Drolen, Jr.
4,363,419 A 12/1982 Walz, Sr.
4,402,421 A 9/1983 Ruemer, Jr.
RE31,702 E 10/1984 Brown
4,504,181 A 3/1985 Khoury
4,576,305 A 3/1986 Saunders
4,733,793 A 3/1988 Moen
4,796,772 A 1/1989 Nguyen
4,801,038 A 1/1989 Grigorenko
4,804,104 A 2/1989 Moen
4,901,880 A 2/1990 Tatham et al.
4,930,658 A 6/1990 McEldowney
4,994,009 A 2/1991 McEldowney
5,007,554 A 4/1991 Hannon et al.
5,011,037 A 4/1991 Moen et al.
5,064,087 A 11/1991 Koch
5,129,541 A 7/1992 Voigt et al.
5,219,257 A 6/1993 Koch
5,307,947 A 5/1994 Moen et al.
5,373,721 A 12/1994 Welsh et al.
5,375,729 A 12/1994 Schubert
5,405,039 A 4/1995 Komura
5,456,378 A 10/1995 DeMars
5,555,992 A 9/1996 Sedgeley
D382,481 S 8/1997 McEldowney
5,653,355 A 8/1997 Tominaga et al.
D385,192 S 10/1997 Hurst et al.
5,692,636 A 12/1997 Schubert
5,711,448 A 1/1998 Clarke, III
5,715,964 A 2/1998 Turner et al.
5,738,237 A 4/1998 McEldowney
D397,296 S 8/1998 McEldowney et al.
D402,555 S 12/1998 McEldowney et al.
5,860,553 A 1/1999 Schubert
5,875,911 A 3/1999 McEldowney
5,934,498 A 8/1999 Jordan
6,024,239 A 2/2000 Turner et al.
D424,438 S 5/2000 Turner et al.
6,129,230 A 10/2000 Turner et al.
6,161,717 A 12/2000 Forrest et al.
6,164,480 A * 12/2000 Heinicke et al. ..... 220/269
6,260,728 B1 7/2001 Turner et al.
6,330,954 B1 12/2001 Turner et al.
6,354,453 B1 * 3/2002 Chasteen ..... 220/269
2002/0113069 A1 8/2002 Forrest et al.
2003/0034346 A1 2/2003 Turner et al.
2003/0042258 A1 3/2003 Turner et al.

* cited by examiner

MODIFIED SCORE FOR SMOOTH OPENABILITY

TECHNICAL FILED

The present invention relates to end closures for beer and beverage containers; and, more specifically, easy-open container ends having a large-opening panel with a smooth rupture of the score during opening by the user.

BACKGROUND OF THE INVENTION

Typical end closures for beer and beverage containers have an opening panel and an attached leverage tab for pushing the opening panel into the container to open the end. The container is typically a drawn and ironed metal can, usually constructed from a thin plate of aluminum. End closures for such containers are also typically constructed from a cutedge of thin plate of aluminum or steel, formed into a blank end, and manufactured into a finished end by a process often referred to as end conversion. These ends are formed in the process of first forming a cutedge of thin metal, forming a blank end from the cutedge, and converting the blank into an end closure which may be seamed onto a container.

These types of container ends have been used for many years, with almost all such ends in use today being the "ecology" or "easy open stay-on-tab" ends in which the tab remains attached to the end after the opening panel is opened. Throughout the use of such ends, manufacturers have sought to save the expense of the metal by downgauging the metal of the ends and the tabs. More recently, manufacturers have sought to provide container ends that have larger openings even as the overall diameters of the container ends have been reduced.

Because ends are used for containers with pressurized contents and/or contents that require heat treatment of pasteurization, the score of the opening panel must have sufficient score residual to withstand such pressure, which in turn requires that the tab have a thickness of metal to provide strength to open the panel. This produces a limitation to the desired metal reduction sought by manufacturers. The tab must have a thickness that imparts strength for opening the end member, and which provides reliability for opening the tear panel opening of the end member.

The more recent popular use of large-open ends provides additional difficulties for openability of the ends. Because of the enlarged size of the opening tear panel, at least in part resulting from the geometry of the score-line (as the opening is defined by a score with a greater width in the space between the rivet and the outer periphery of the panel), more stress is placed on the tab during opening of the tear panel of the end. This constrains efforts to further down-gauge the tab, and causes certain inconveniences for the user when opening the can. One example of this difficulty is presented due to the geometry of the large-opening end having an expanded width of the tear panel. The tear panel of the large-opening end has an expanded width due to the limited space available for the placement of the tear panel between the central rivet and the outer edge area of the end. Because of this geometry and the limitations of the tab placement on the end, the large-opening ends usually have tear panels that have regions more difficult to open by the tab leveraging against the tear panel. This is especially true for the region of the score which is in the 4:00 to 6:00 clock position, with the area of the tear panel closest the rivet being the 12:00 placement (and the 12:00 to 6:00 orientation of the tear panel is defined along a central axis of the tear panel passing through the rivet, the tab nose and the opposed lift-end of a typical arrangement).

The 4:00 to 6:00 region of the score peripheral geometry, and especially the 5:00 region, will typically include a curvilinear shaped segment with a relatively sharp radius of curvature to direct the tear panel score-line back toward the hinge segment to form a complete loop. This geometry presents resistance to the fracture of the score residual of metal in that region of the tear panel. Also, with the 4:00 to 6:00 region of the score geometry being a score segment located relatively distant from the tab nose, and thereby being further from the application of the opening force applied by the user, the user must apply additional leverage force by the tab to gain the needed force to continue the fracture of score in that distal region. Further, when the score of the typical tear panel in the 4:00 to 6:00 region is ruptured during opening, the shape of the tear panel requires displacement at an angle outward of the axis of the tab. The angular deflection of the tear panel is then shifted across the tab axis as the 4:00 to 6:00 region is fractured. This requires an additional amount of leverage by the tab nose to continue the opening of the tear panel relative to the initial areas of the tear panel.

When experiencing such resistence to openability, the user typically compensates by sustaining and increasing the lifting force of the tab, thereby pushing the nose of the tab harder on the tear panel. In this typical situation, the force on the tear panel continues until the resistance to opening is overcome, and the score quickly fractures past the 4:00 to 6:00 region and the opening of the tear panel is completed. Such a sequence of resistance, opening-force increase by the user, and rapid fracture of the score, results in the tear panel to quickly open past the 4:00 to 6:00 region. This causes the tear panel to quickly bend into the container toward the container contents. The result the tear panel slapping onto the liquid contents, which splashes the liquid contents upward to exit the opening as a "spitting," or "spewing" of the liquid contents from the opening in the can end.

Another problem with large-opening container ends is the restriction to the material and cost savings when seeking to make the ends from a thinner metal stock (down-gauging). This is primarily due to the fact that the geometry of the tear panel, and the limited space between the rivet and outer panel edge. Because the typical tear panel for a large-opening end is generally symmetrical when divided through the central axis, the tear panel shape may require one to make the ends from a larger cutedge of metal to provide the space needed for the tear panel. For example, one design constraint that limits panel down-sizing is that such down-sizing, which leaves less space for the tear panel between the rivet and the outer peripheral edge, leads to the need for a sharper (smaller) radius of curvature at the 5:00 region of the tear panel. As the panel size is reduced, less space is available for the tear panel and smaller radius of curvature is required. Therefore, there is a need for a score panel geometry that provides a large opening that does not require a sharp radius in the 5:00 region.

As is explained in greater detail below, the present invention reduces or eliminates these problems with container ends. The present invention provides variations for overcoming the specific difficulties associated with design, manufacture and use of large-open beverage container ends.

SUMMARY OF THE INVENTION

It is an object of the present invention to provide a retailed-tab "ecology" container end member having a displaceable tear panel defined by a frangible score and a non-frangible hinge segment and in which the tear panel has a geometrical arrangement adapted to facilitate smooth opening of the end without substantial resistance to opening. The frangible score has an outer periphery defined by a curvilinear score length and a score residual thickness adapted to fracture when subject to opening force applied by the tab nose caused by a lifting of the tab lift end. The tear panel has a mid-sectional width defined along a cross axis residing perpendicular to a sectional axis, and in which the sectional axis and said cross axis divide the tear panel into four separate quadrants. The score length has an enlarged radius of curvature in the second quadrant relative to the radius of curvature in the first quadrant. It is also an object of the invention to provide an end member in which the first quadrant is positioned adjacent the tab and at a vent region of the tear panel, and the score of the first quadrant is curvilinear with a radius of curvature greater than a radius of curvature of the score in the third quadrant.

It is another object of the invention to provide a container end member with a central panel wall with a tab secured to the public side and a central longitudinal axis the tab nose and the opposed lift-end. The central longitudinal axis defines a division between a first side from that of a second side, wherein a displaceable tear panel has a tear-drop shape with a first-more narrow portion on one side of the axis and a second wider portion located on the other side of the axis.

It is further an object of the present invention to provide an end member with a displaceable tear panel defined by a frangible score with a central longitudinal axis along a 12:00–6:00 clockwise reference line, and with a radius of curvature in a 5:00 region that is greater that radius of curvature of the score in an 8:00 region. It is also an object for the tear panel of the end member to have an enlarged radius of curvature in the 4:00 to 5:00 region that is larger than the radius of curvature along other portions between the 2:00 to 10:00 regions of the score periphery. It is also an object of the invention to provide an end member with an enlarged radius of curvature at the second curved segment that is configured to provide minimal resistance to the fracture of the score by application of the opening force by the user. The structure of the end member score shape, and the method of making the same, provides ease of opening of the tear panel that reduces resistance to opening, especially in the 5:00 region of the score shape. This reduces the slapping of the tear panel into the container during opening of the tear panel, and provides a geometry of the score for smooth openability by minimizing resistance to score fracture, especially the score fracture at the curved segment located between the vent area of the score and the area closest to the outer peripheral edge of the end member.

DETAILED DESCRIPTION

Figure 1:
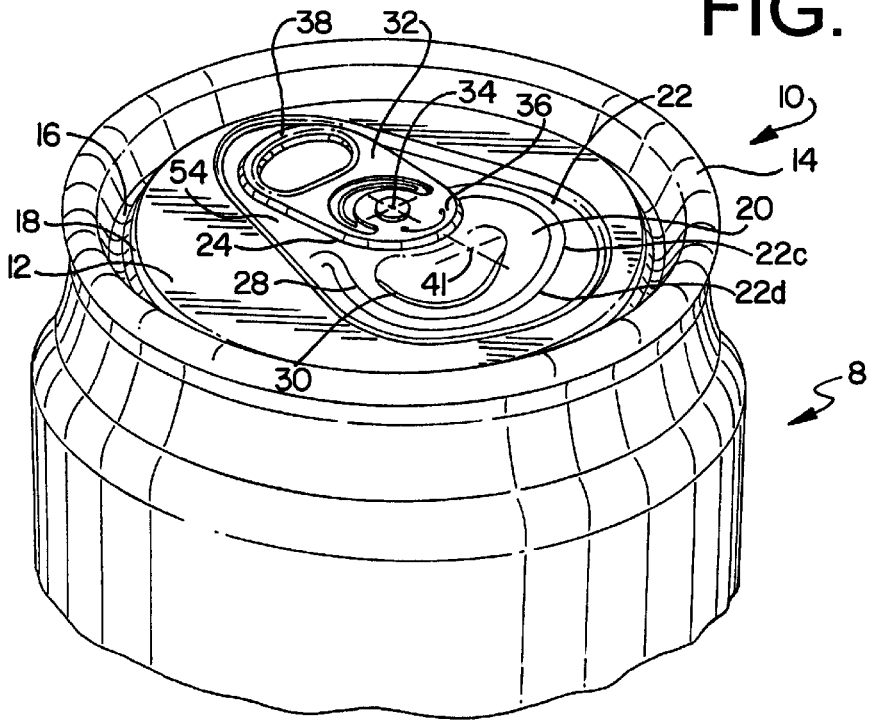
FIG. 1 is a perspective view of a container end member made according to the present invention and which is seamed onto a container that is show in partial view.

While this invention is susceptible of embodiment in many different forms, there are shown in the drawings and will herein be described in detail preferred embodiments of the invention with the understanding that the present disclosure is to be considered as an exemplification of the principles of the invention and is not intended to limit the broad aspect of the invention to the embodiments illustrated.

The Figures show the article of the present invention, made according to the manufacturing method of the invention. The container end of the present invention has improved opening characteristics, having structure adapted to provide a large-opening end with a tear panel geometry to overcome difficulties associated with prior art end. The structure of the end according to this invention provides a tear panel with a larger radius in the first curved portion of the score residing distal to the tab, an area that may be identified as about the 5:00 region of the tear panel. This structure is adapted to provide improved and smooth openability of the tear panel by the user.

In the embodiment of FIGS. 1–6, the end closure 10 for a container 8 has a central panel wall 12 having a seaming curl 14 for joining the wall to the container 8. The container 8 is typically a drawn and ironed metal can, usually constructed from a thin plate of aluminum or steel. End closures for such containers are also typically constructed from a cutedge of thin plate of aluminum or steel, formed into blank end, and manufactured into a finished end by a process often referred to as end conversion. In the embodiment shown in the Figures, the central panel 12 is joined to a container by a seaming curl 14 which is joined to a mating flange of the container 8. The seaming curl 14 of the end closure 10 is integral with the central panel 12 by a countersink area 16 which is joined to the panel peripheral edge 18 of the central panel 12. This type of means for joining the central panel 12 to a container 8 is presently the typical means for joining used in the industry, often called "seaming." However, other means for joining the central panel 12 to a container 8 may be employed with the present invention.

The steps of manufacturing the end begin with blanking the cutedge, typically a circular cutedge of thin metal plate. The cutedge is then formed into a blank end by forming the seaming curl, countersink, panel radius and the central panel. The conversion process for this type of end closure includes the following steps: forming a rivet by first forming a projecting bubble in the center of the panel and subsequently working the metal of the bubble into a button and into the more narrow projection of metal being the rivet; forming the tear panel by scoring the metal of the panel wall with a curvilinear score shape having a geometry according to the details of the invention; foaming an inner bead, or similar feature of a bend of metal, on the tear panel; forming a deboss panel by bending the metal of the panel wall such that a central area of the panel wall is slightly lower than the remaining panel wall; staking the tab to the rivet; and other subsequent operations such as wipe-down steps to remove sharp edges of the tab, lettering on the panel wall by scoring or embossing (or debossing), and restriking the rivet island. This conversion process is further described below with description of the structure of the end closure.

The central panel wall 12 has a displaceable tear panel 20 defined by a frangible score 22 and a non-frangible hinge segment 24. The tear panel 20 of the central panel 12 may be opened, that is the frangible score 22 may be severed and the tear panel 20 displaced at an angular orientation relative to the remaining portion of the central panel 12, while the tear panel 20 remains hingeably collected to the central panel 12 by the hinge segment 24. In this opening operation, the tear panel 20 is displaced at an angular deflection. More specifically, the tear panel 20 is deflected at an angle relative to the plane of the panel 12, with the vortex of the final angular displacement being the hinge segment 24. Additional details of this opening operation, and the sequence of fracture of the segments of the score 22, are covered in detail below.

The tear panel 20 is formed during the conversion process by a scoring operation. The tools for scoring the tear panel 20 in the central panel 12 include an upper die on the public side having a scoring knife edge in the shape of the tear panel 20, and a lower die on the product side to support the metal in the regions being scored. When the upper and lower die are brought together, the metal of the panel wall 12 is scored between the dies. This results in the scoring knife edge being embedded into the metal of the panel wall 12, forming the score 22 which appears as a wedge-shaped recess in the metal. The metal remaining below the wedge-shaped recess is the residual of the score 22. Therefore, the score 22 is formed by the scoring knife edge causing movement of metal, such that the imprint of the scoring knife edge is made in the public side of the panel wall 12. In this score arrangement, an anti-fracture score 28 is formed with the same manufacturing step as the score 22, with the anti-fracture score 23 being formed by a score knife tool that embeds into the metal of the panel 12 at a lesser depth than the score 22. This arrangement of an anti-fracture score 28 positioned radially inward on the tear panel 20 from the score 22 is a typical practice for enhanced scoring characteristics. The present invention may also be practiced with other score arrangements that do not include a separate anti-fracture score 28, including typical scores 22 formed with stepped scoring knife tools that essentially coin or compress an area of the metal immediately adjacent the score 22 grove.

The tear panel 20 may also be formed with a stiffening bend of metal in the central region of the tear panel 20, such as an inner tear panel bead or similar structure of a raised or lowered bend of metal 30. The inner bead or bend 30 may be used to remove a degree of slack of excess metal in the tear panel 20. The inner bead structure 30 may be used to provide better leverage by opening force on the tear panel 20 by the tab 32. The tear panel bead structure 30 is preferably formed in a shape which generally follows the geometric shape of the score 22 of the tear panel 20, thereby evenly drawing slack metal from the tear panel 20.

The opening of the tear panel 20 is operated by the tab 32 which is attached to the central panel 12 by a rivet 34. The tab 32 is attached to the central panel 12 such that the nose 36 of the tab 32 extends over a proximal portion of the tear panel 20. The lift end 38 of the tab 32 is located opposite the tab nose 36 and provides access for a user to lift the lift end 38, such as with the user's finger, to force the nose 36 against the proximal portion of the tear panel 20.

The score 22 has a first segment 22*a* at least partially positioned under the tab nose 36 and having a vent region 40 which is the portion of the score 22 which initially fractures during opening. The score 22 further has a curvilinear second segment 22*b* extending from the first segment 22*a* and directing the score path radially outward, toward the outer peripheral edge 18 of the panel 12, and leading to a curvilinear third segment 22*c* with a transition zone, generally indicated as 22*d*. The third segment 22*c* is a curvilinear segment of the score 22 that directs the score path at an angle away from the panel outer peripheral edge 18. In this manner, the curve of the third segment 22*c* passes adjacent the peripheral edge 18 as a first radially-distal curved segment, positioned radially outward relative to the curved segment 22*b* located near the vent region 40. A fourth segment 22*e* continues from the third segment 22*c* throughout the remainder of the score 22, and terminates adjacent the hinge segment 24. During opening of the tear panel 20, therefore, the score 22 initially ruptures (i.e. the score residual being severed) in the vent region 40 of the first score segment 22*a*, and the rupture of the score 22 propagates in sequence through the second segment 22*b*, the third segment 22*c*, and finally through the fourth segment 22*e*.

Figure 2:
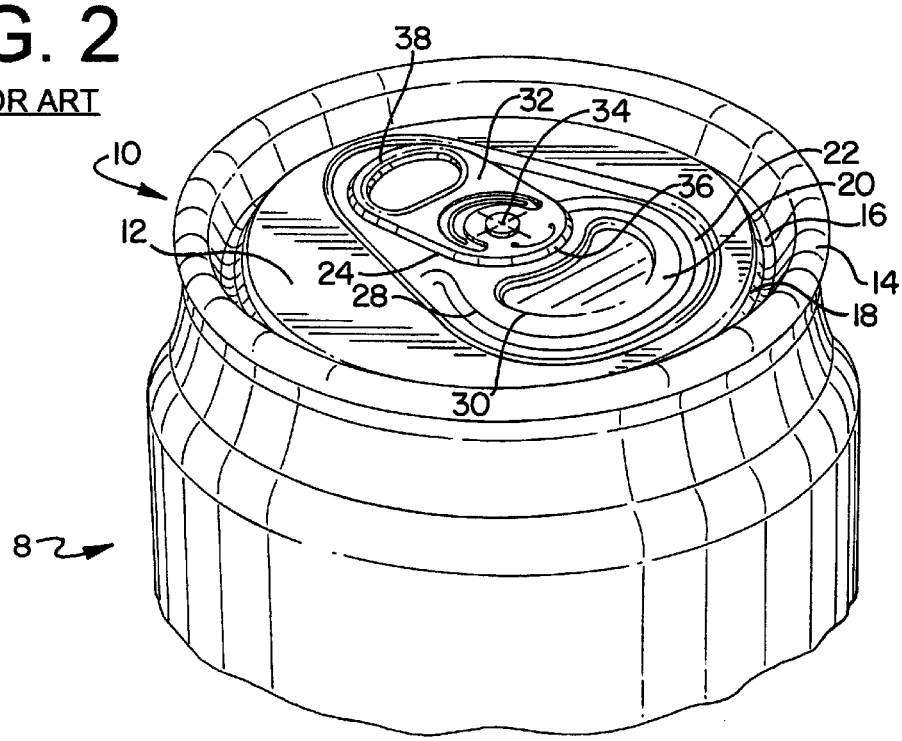
FIG. 2 PRIOR ART
FIG. 2 (Prior Art) is a perspective view of a large-opening container end made according to the prior art and which is seamed onto a container that is shown in partial view.

In typical prior art large-opening ends, such as shown in FIG. 2, the score 22 has a generally symmetrical appearance between the right and left halves of the tear panel 20, with the center dividing line being the axis through the rivet 34 and the tab length. In this typical construction, the transition zone 22*d* of the score 22 is one region of the tear panel score 22 which exhibits a relatively large resistance to opening force, usually resulting from the combination of the sharp curvature of the curvilinear geometry of the segment 22*c* in the transition zone 22*d*, and due to the fact that the tab nose 36 contacts the tear panel 20 at a distance from the transition zone 22*d*. This becomes better understood by studying the process by which an end 10 is opened by the user.

During opening of the can end 10, the user lifts the tab 32 at the lift end 38, which causes the tab nose 36 to press against the tear panel 20 that resides under the nose 36. When the tab nose 36 is forced against the tear panel 20, the score 22 initially ruptures at the vent region 40 of the score 22 of the tear panel 20. This initial rupture of the score 22 is at least partially caused by the lifting force on the tab 32 resulting in lifting of a central region of the center panel 12, immediately adjacent the rivet 34. This lifting force of the rivet 34 area of the panel 12 relative to the tear panel 20 causes separation of the residual metal 26 of the score 22. The force required to rupture the score 20 in the vent region 40, typically referred to as the "pop" force, is a lower degree of force relative to the force required to propagate other regions of the score 22 by continued lifting of the lift end 38 of the tab 32. Therefore, it is preferable that the panel 12 in the area around the rivet 34 only lifts enough to assist with initial score rupture, or "pop," and remains substantially stiff and flat to provide the needed leverage for the tab 32 to propagate the score-line of the tear panel 20.

After the initial "pop", or "venting" by separation of the vent region 40 of the tear panel 20, the user continues to lift the lift end 38 of the tab 32 which causes the tab nose 36 to be pushed downward on the tear panel 20 to continue the rupture of the score 22, as an opening force. The rupture of the score 22 thereby progresses from the vent region 40 to the proximal curved segment of the score, which is located in the score second segment 22*b* immediately adjacent the vent region 40 and near the rivet 34. The curvature of the score 22 in this region 22*b* directs the score 22 toward the peripheral edge 18 of the panel 12, radially outward of the rivet 34. The score fracture then proceeds from the second segment 22*b* to a third segment 22*c*, which includes a transition zone 22*d*, and on around the score geometry to fracture the score 22 through a fourth segment 22*e*. As the opening operation is continued around the score geometry, the tear panel 20 is displaced downward and is rotated about the hinge region 24 such that the tear panel 20 is deflected into the container along an angular displacement relative the panel 12. During this continued score fracture propagation, the transition zone 22*d* exhibits a relatively high degree of resistance, requiring a great amount of leverage and opening force, as is described below.

As shown in the FIGS. 3–6, the third segment 22*c* has a geometry that curves in a directional path generally opposite the directional path of the score 22 in the first segment 22*a* and the second segment 22*b*. During opening, this alteration of the directional path of the score 22 in the third segment 22*c*, and specifically in the transition zone 22*d*, results in an amount of resistence to opening because the continued fracture of the score 22 is forced in a changed direction from the preceding score segment, the second segment 22*b*. This results in difficulty of opening the tear panel 20, appearing as propagation of the fracture of score being slowed and even stopped in the third segment 22*c*. The difficulty in opening this region of the tear panel 20 is rendered even more noticeable due to the fact that the third segment 22*c* (and specifically the transition zone 22*d*) is the first distal curved segment of the score 22 that resides further away from the leverage point for opening the tear panel 20 (i.e., the tab nose 36).

Therefore, the score of traditional large-opening can ends 10, having a tear panel 20 substantially wider than the tab 32 and with an opening area greater than 0.5 square inches, is difficult to fracture in the transition zone 22*d* at approximately the 4:00 to 6:00 clock position (with the score 22 immediately adjacent the rivet 34 being the 12:00 clock position). The force needed to fracture the remainder of the third segment 22*c* and the fourth segment 22*e* is much less relative to the transition zone 22*d*, which can result in the tear panel 20 being suddenly forced into the container, potentially resulting in the tear panel 20 slapping against the product within the container. This slapping of the product (such as beer or beverage) potentially results in product shooting out of the tear panel 20 opening, an undesirable condition referred to as spitting spewing or splashing of product. Also, as the industry continually seeks to downgauge the metal of the end 10 and the tab 32 (i.e., use thinner gauge to save material costs), increased efficiency in opening by the tab 32 permits the use of a tab 32 made of thinner and/or less metal.

Figure 3:
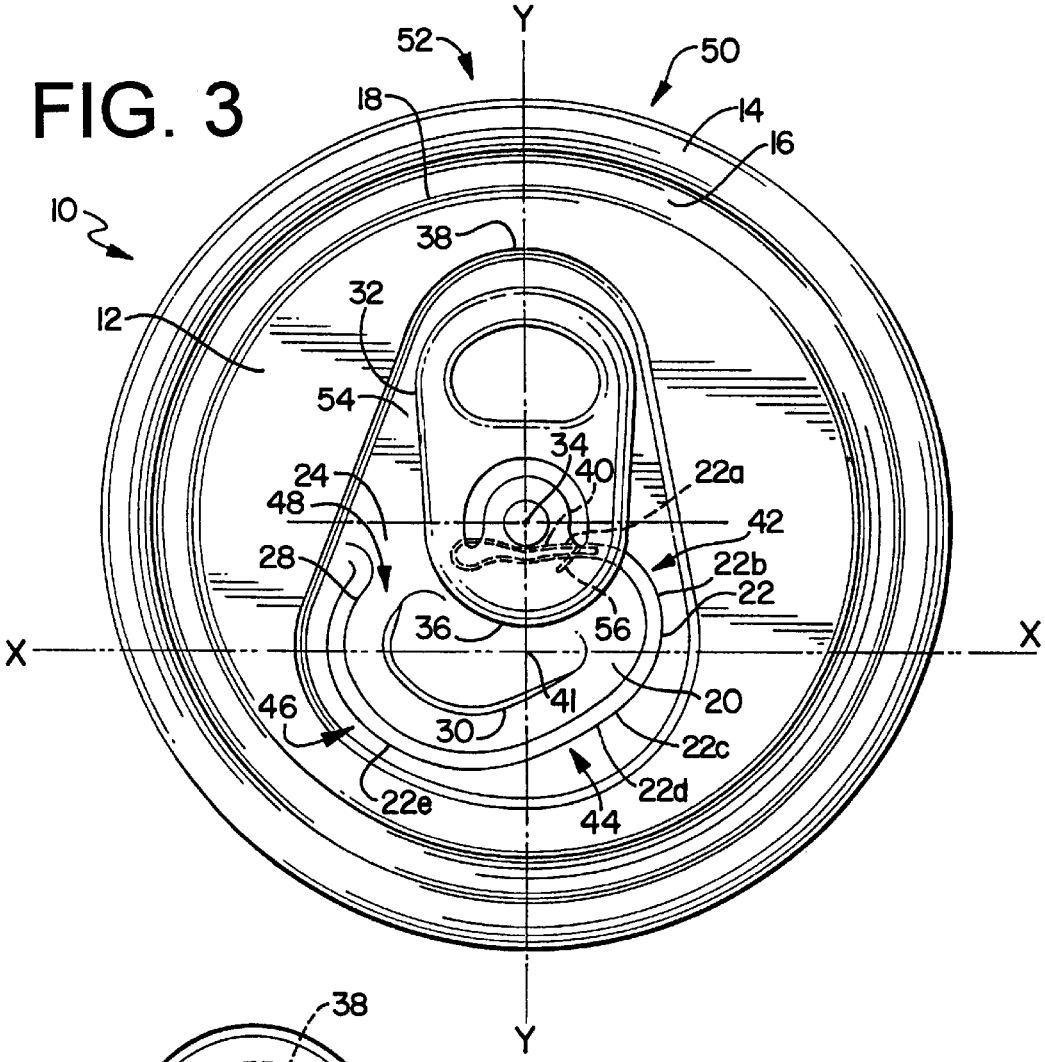
FIG. 3 is a top plan view of the container end member shown in FIG. 1.
Figure 4:
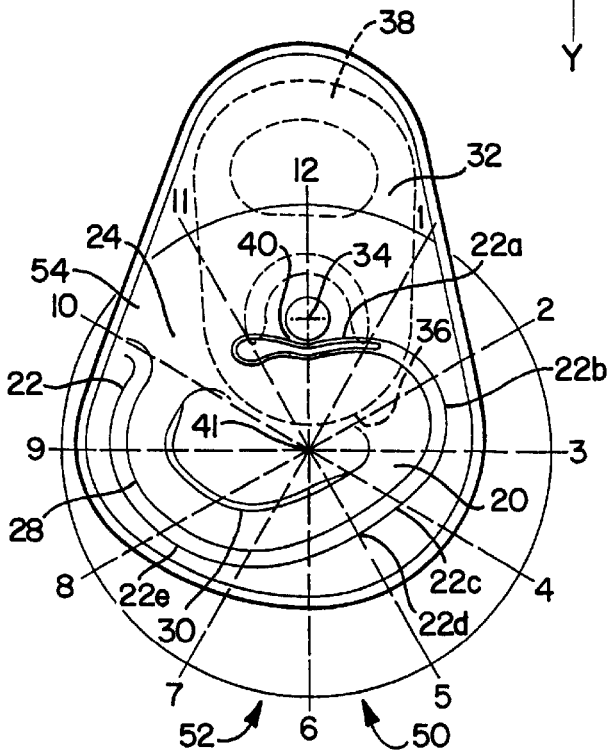
FIG. 4 is a top plan view of a portion of the end member shown in FIG. 3, including the tab shown in broken lines and a circular reference indication of clockwise orientation around the tear panel of the end member.
Figure 5:
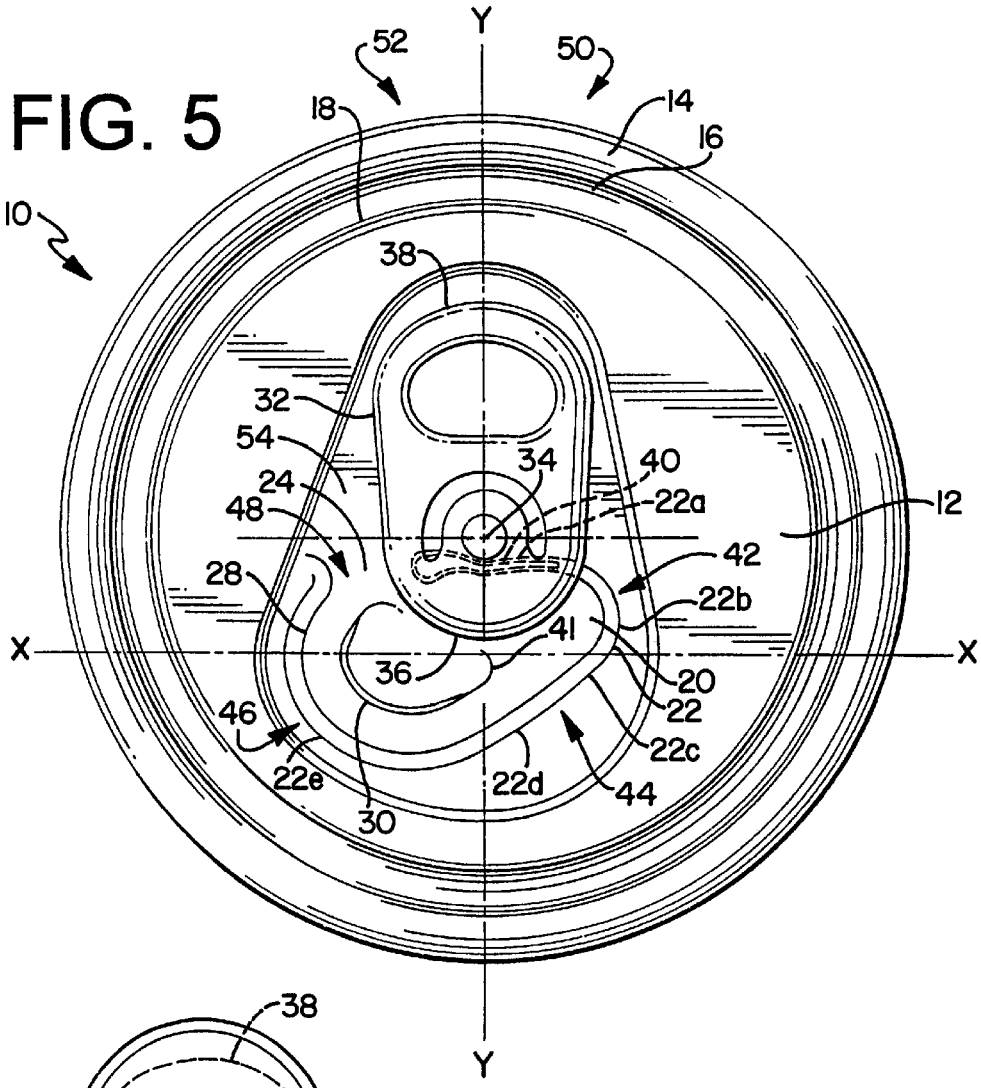
FIG. 5 is a top plan view of an alternative embodiment of the end member made according to the invention.

To provide improved structure for smooth fracture and improved openability of the tear panel 20, the present invention provides a large-opening tear panel 20 geometry with a larger radius in the transition zone 22*d* in the third segment 22*c* of the score 22. To achieve this larger radius of the transition zone 22*d* and yet provide the large-opening area of the tear panel 20 (at least approximately 0.5 square inches in area), the geometrical shape of the score 20 appears drastically non-symmetrical between two halves of the tear panel 20 when divided along a central axis Y—Y passing through the length of the tab 32 and through the rivet 34. The non-symmetrical tear panel 20, as shown in the embodiments of FIGS. 3 and 5, provides a tear panel 20 adapted for reduced resistence to fracture of the score 22 in the transition zone 22*d*, the first curved segment of the score 22 that is positioned across the length of the tear panel 20 from the rivet 34. This provides a smooth curvature of the score 22 in the transition zone 22*d*, as an enlarged radius of curvature, substantially expanded from that of the prior art. It also provides an enlarged radius of curvature that is larger than the radius of curvature of any other region (22*b* and 22*e*) of the tear panel 20 that is exposed from the tab 32. Therefore, having a transition zone 22*d* with a larger radius of curvature than all but the vent region 40, provides a transition zone 22*d* with reduced resistence to fracture of the score 22 and improved openability of the end 10.

This aspect of the present invention may be demonstrated by the examples of the embodiments shown in FIGS. 3–6, in which the large-opening ends each have a tear panel 20 with a central axis Y—Y that passes along the tab length between the nose 36 and the lift end 38, and passes through the center of the rivet 34. The ends of these embodiments also each have a cross axis X—X of the tear panel 20 that divides the tear panel 20 across its width and transects the central axis Y—Y perpendicular to the central axis at an axis point 41.

The crossing of the central axis Y—Y and the cross axis X—X divide the tear panel 20 into four separate quadrants. The first quadrant 42 is adjacent the rivet 34 and in the vent region 40 of the tear panel 20. The first quadrant 42 is the area of the tear panel score 22 in which the score propagates after the initial pop of score fracture. The score 22 in the first quadrant 42 has a curved segment 22*b* that directs the score-line from a direction extending away from the axis Y—Y to a direction generally parallel the axis Y—Y. Essentially, this segment of the score 22*b* forms the first curved segment of the score 22 to form the curvilinear tear panel 20. The second quadrant 44 is also a curvilinear segment of the score 22, which directs the score 22 into a direction generally toward the axis Y—Y. In accordance with practice of the present invention, the score 22 in the second quadrant 44 has a shape that is adapted for smooth fracturing of the score 22. The shape of the score 22 in this area of the panel 20 has a transition zone 22*d* with an enlarged radius of curvature. In a preferred embodiment, the enlarged radius in the transition zone 22*d* provides a score geometry with a substantially linear segment at the transition zone 22*d*. In this arrangement, the transition area 22*d* is not the radially outermost curved segment (the curved segment closest the peripheral edge 18). Instead, the radially outermost curved portion of the tear panel 20 resides in the third quadrant 46. This is shown in FIG. 3, for example, as the curvilinear segment of the score 22 in the second quadrant 44 is further from the peripheral edge 18 relative to the score 22 in the third quadrant 46. Indeed, because of the expanded shape of the tear panel 20 in the third quadrant 46, the score 22 in the third quadrant 46 is the area of the score 22 that is closest to the peripheral edge 18. When the tear panel 20 is opened, therefore, the opening of the can end 10 has an outermost area that extends between the hinge region 24 and the central axis Y—Y.

Figure 6:
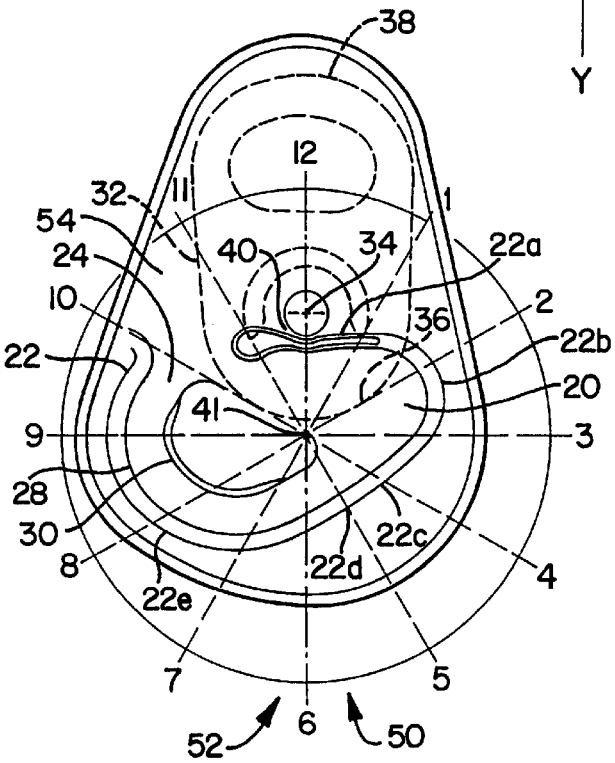
FIG. 6 is a top plan view of a portion of the end member shown in FIG. 5, including the tab shown in broken lines and a circular reference indication of clockwise orientation around the tear panel of the end member.

In the embodiment shown in FIGS. 5–6, the score 22 in the second quadrant 44 at the transition zone 22*d* has a substantially linear extent that extends across the second quadrant 44 between the first quadrant 42 to the third quadrant 46. This substantially linear extent of the score 22 in the transition zone 22*d* provides minimal resistence to fracture of the score 22 in the 4:00 to 6:00 region of the tear panel 20. Indeed, in the embodiment shown in FIG. 6, the linear extent 22*d* of the shape of the score 22 passes from the cross axis X—X (at the 3:00 region) though the distal side of the central axis Y—Y (at the 6:00 region).

The third quadrant 46, which lies on the other side of the central axis Y—Y relative to the expanded radius of the transition zone 22*d*, includes an expanded body area and bolus width as measured along the X—X axis. The expanded body area in the third quadrant 46, and the fourth quadrant 48, provides a widened and expanded surface area of the opening of the tear panel 20. This structure provides an enlarged opening as a "large-opening end" even though the larger radius in the transition zone 22*d* reduces the surface are of the second quadrant 44. Therefore, the non-symmetry of the score geometry, and the resulting non-symmetry of the tear panel 20 opening, provides a third quadrant 46 and a fourth quadrant 48 with an enlarged surface area relative the area of the tear panel 20 on the other side (the first side 50) of the central axis Y—Y.

In the embodiment shown in the Figures, the difference in surface area of the tear panel 20 non-symmetrical halves (comparing the first side 50 of the axis Y—Y to the area of the second side 52 of the axis Y—Y) is readily noticeable. For example, the portion of the tear panel 20 on the first side 50 may be one-third less than the surface area on the second side 52, as is visible in FIG. 3. This difference in surface area may be greater, such as is shown in FIG. 5, in which the area of the first side 50 is visibly approximately one-half the surface area of the tear panel 20 of the second side 52.

The disproportion of the non-symmetry of the tear panel 20 is also made apparent in comparison of the surface area of the second quadrant 44 with the surface area of the third quadrant 46. For example, in the embodiment shown in FIG. 3 and 5, the tear panel 20 has a surface area in the second quadrant 44 that is in the range of approximately one-third to one-half of the surface area of the tear panel 20 in the third quadrant 46.

Viewing the tear panel 20 in a clock-wise orientation also may be used to distinguish the structural features of the present invention. With the 12:00 position being the location of the score 22 being closest the central rivet 34, the clock-orientation of the tear panel 20 may be visualized, such as in FIGS. 4 and 6. In this arrangement, the central axis Y—Y of the panel 12, and the central axis Y—Y of the tear panel 20, is defined along a line that passes through the center of the rivet 34 and passes through the mid-section of the tab 32 from the nose 36 and the lift end 38. The cross axis X—X passes through the maximum width of the tear panel 20 and resides along the 3:00 to 9:00 orientation. Each quadrant has a median axis between the central axis Y—Y and the cross axis X—X, passing from the axis point 41 to an outer edge of the tear panel 20. In this arrangement of the can end structure, the transition zone 22*d* at the 5:00 region has an expanded (enlarged) radius of curvature that provides a direct line of the score 22 through that segment toward the 6:00 position. In the embodiments shown in FIGS. 3–6, the region between the 3:00 to 6:00 orientation has such an expanded radius of curvature. In these embodiments in practicing the invention, it is especially important for the zone in the areas of 4:00 to 6:00 orientation to have a greater radius of curvature, such that fracture of the score 22 during opening has reduced resistence for smooth opening of the tear panel 20.

Also, in this arrangement, the area of the tear panel 20 at the 4:00 to 6:00 regions has a greater radius of curvature relative to the area in the 6:00 to 8:00 region. This structure provides an expanded radius in the transition zone 22*d* with an expanded surface area of the tear panel 20 in the 6:00 to 8:00 region to provide a "large-opening" tear panel 20. Such a large-opening tear panel, sometimes having been described in the prior art as having an opening of at least 0.5 square inches, typically have a sharp curve in the 5:00 region. This presents one significant aspect of the improvement of the present invention. The present invention provides the structure of a large-opening score panel 20 with smooth opening of score fracture in the 5:00 region of the tear panel 20. In this arrangement, the score 22 in the 5:00 region of the tear panel 20 is positioned closer to the axis point 41 than the score in the 6:00 to 9:00 regions.

Figure 8:
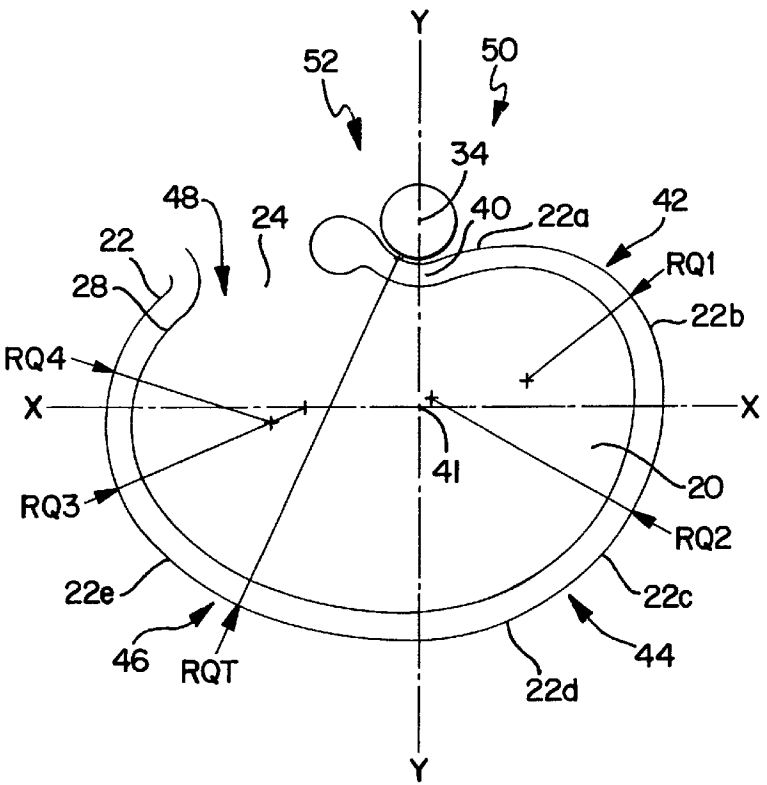
FIG. 8 is a top plan view of a portion of the end member shown on FIG. 7.
Figure 7:
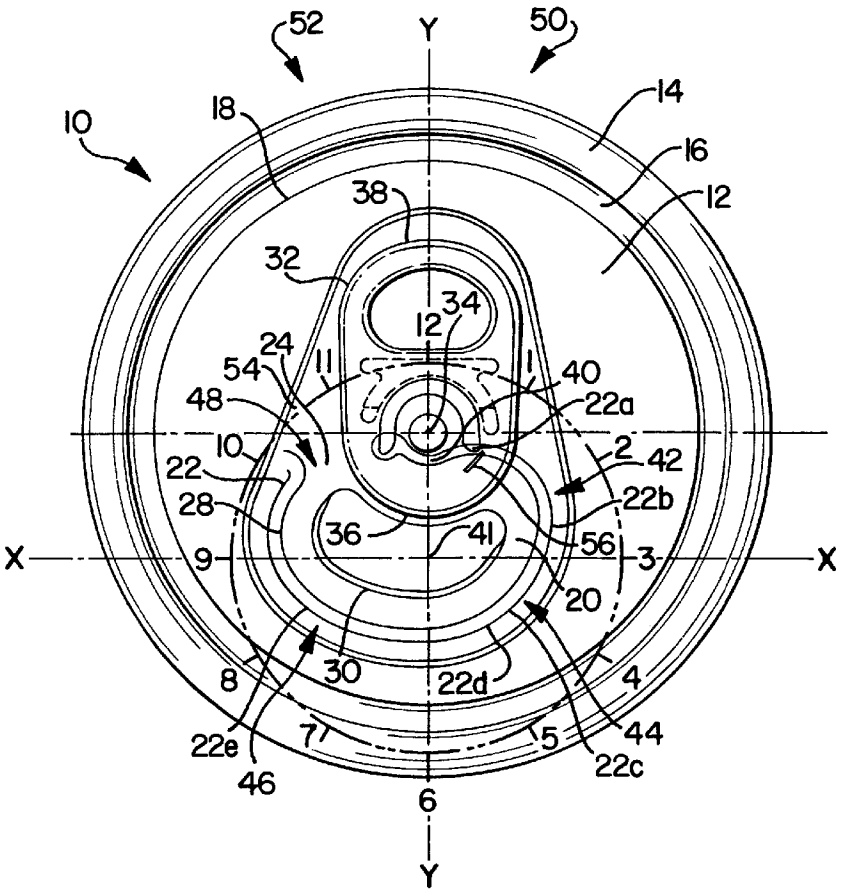
FIG. 7 is a top plan view of an alternative embodiment of the end member made according to the invention, including a circular reference indication of clockwise orientation around the tear panel of the end member.

Referring to FIGS. 7 and 8, an alternate embodiment of the can end 10 is illustrated. In this embodiment, a radius of curvature $R_{Q1}$ in the first quadrant 42 is approximately two-thirds to one-half a radius of curvature $R_{Q2}$ in the second quadrant 44, or any range or combination ranges therein. Further, a radius of curvature $R_{Q3}$ in the third quadrant is approximately three-quarters to seven-eighths of the radius of curvature $R_{Q2}$, or any range or combination ranges therein, and a radius of curvature $R_{Q4}$ is approximately one-half to two-thirds of the radius of curvature $R_{Q2}$, or any range or combination ranges therein. A radius of curvature $R_{QT}$ in the transition zone 22*d* is approximately one and three-quarters to two times the radius of curvature of $R_{Q2}$, or any range or combination ranges therein. More preferably, $R_{Q1}$ is 0.180 to 0.242 inches or any range or combination ranges therein; $R_{Q2}$ is 0.378 to 0.432 inches or any range or combination of ranges therein; $R_{Q3}$ is 0.313 to 0.367 inches or any range or combination of ranges therein; $R_{Q4}$ is 0.248 or 0.302 inches or any range or combination of ranges therein; and $R_{QT}$ is 0.628 to 0.682 inches or any range or combination of ranges therein.

Tests were conducted on 202 can ends having a large opening tear panel 20 with the score 22 characteristics illustrated in FIG. 7. The score residual 26 at the 6:00 position was varied as was the depth of a deboss panel 54 surrounding in which the tear panel 20 is located, and a vent coin 56. Table 1 summarizes the splash results of the trials.

TABLE 1

| Trial No. | Residual at 6:00 | Deboss Panel Depth | Vent Coin Depth | Distance of Splash |
|---|---|---|---|---|
| 1 | 0.0030 in. | 0.012 in. | 0.0063 in. | 3.9 in. |
| 2 | 0.0030 | 0.018 | 0.0063 | 3.7 |
| 3 | 0.0030 | 0.018 | 0.0063 | 5.8 |
| 4 | 0.0030 | 0.018 | 0.0074 | 3.1 |
| 5 | 0.0030 | 0.018 | 0.0074 | 4.6 |
| 6 | 0.0034 | 0.015 | 0.0068 | 1.5 |
| 7 | | | | 8.1 |
| 8 | | | | 7.5 |

Trials 7 and 8 were conducted on commercially available can ends. The can ends 10 having a modified score radius exhibited an average splash distance of 4.2 inches compared to 7.8 inches for the commercially available can ends.

While specific embodiments have been illustrated and described, numerous modifications come to mind without significantly departing from the spirit of the invention and the scope of protection is only limited by the scope of the accompanying claims.

I claim:

1. An ecology end member for a beverage container, comprising:

a central panel wall having a product side and a public side with an outer peripheral edge, a non-detachable tab being secured to the public side of the central panel wall by a rivet of the center panel;

a displaceable tear panel in the central panel wall adjacent the rivet, said tear panel being defined by a frangible score and a non-frangible hinge segment, the frangible score having a tear panel geometry with an outer periphery defined by a curvilinear score length, said tear panel geometry being asymmetrically skewed having a large radius of score curvature in a first outer quadrant of the tear panel to provide low resistence to opening the tear panel at said large radius, and the tear panel having a radially outermost segment of the score located in a different quadrant of the tear panel.

2. The end member of claim 1, further comprising a central axis of the tear panel defined along a tab length between a tab nose and a tab lift end and passing through the rivet, the first outer quadrant being located on a first side of the central axis and said different quadrant being located on an opposite side of the central axis.

3. The end member of claim 2, wherein the quadrants of the tear panel are defined by the central axis and a cross axis residing perpendicular to said central axis and passing between a tear panel width, said central axis and said cross axis dividing the tear panel into four separate quadrants with the curvilinear score length in each of said quadrant having a defined radius of curvature, a first inner quadrant being located adjacent the rivet and said first outer quadrant being located radially outward of the first inner quadrant, the score curvature in the first outer quadrant having an enlarged radius of curvature relative to the curvature in the first inner quadrant.

4. The end member of claim 3, wherein the central axis and the cross axis intersect at an axis point, and wherein the score in the first outer quadrant is located closer to the axis point than the position of the score in each of the other three quadrants.

5. The end member of claim 3, wherein the tear panel has a surface area in which a portion of said surface area is located in each of said quadrants, the surface area of the tear panel in the first outer quadrant being less than the surface area of a second outer quadrant positioned adjacent said first outer quadrant.

6. An ecology end member for a beverage container, comprising:

a central panel wall having an outer periphery and having a product side and a public side and having a tab secured to said public side; said central panel having a central axis passing through a rivet and a tab length between a nose of the tab and a substantially opposed lift-end;

a displaceable tear panel in the central panel wall, said tear panel being defined by a frangible score and a non-frangible hinge segment, said frangible score having an outer periphery defined by a curvilinear score length;

said tear panel having a maximum width defined along a cross axis residing perpendicular to said central axis and transecting the central axis at an axis point, said tear panel having four separate quadrants defined by the sectional axis and said cross axis, each said quadrant having a quadrant median axis passing from the axis point to the outer edge of the tear panel;

a first quadrant being positioned adjacent the tab and at a vent region of the tear panel, the frangible score of the first quadrant being curvilinear with a radius of curvature and leading directly to a score segment in a second quadrant, said second quadrant being positioned radially outward of said first quadrant and having a curved segment directing the score adjacent the center panel outer periphery toward a third quadrant, the score segment in said second quadrant being curvilinear with a radius of curvature greater than a radius of curvature of the frangible score in a third quadrant.

7. The end member of claim 6, wherein the radius of curvature of the frangible score in the second quadrant is greater than the radius of curvature of the score in said first and third quadrants and generally larger than the radius of curvature used on current production ends.

8. The end member of claim 6, wherein each said quadrant of the tear panel has an extent of surface area of the panel, said second quadrant having less of said extent of surface area relative to the extent of surface area in said third quadrant.

9. The end member of claim 6, wherein the tear panel has an outermost curved score segment located closest the outer periphery of the central panel wall, said outermost curved score segment being located entirely in said third quadrant.

10. The end member of claim 6, wherein the tear panel has an enlarged opening defined by a width along the cross axis being greater than tear panel width along the central axis.

11. The end member of 10, wherein the tear panel has a maximum width and said maximum width being the linear distance between potions of the frangible score along the cross axis.

12. An end closure for a container, comprising:

a central panel wall having a product side and a public side and having a tab secured to said public side by a central rivet, said central panel having a central axis defined along a line passing through the rivet and passing through a tab length along a nose of the tab and an opposed lift-end of the tab, said central axis defining a division between a first side of the axis from a second side of the axis;

a displaceable tear panel in the central panel wall, said tear panel having a surface area shape defined by a peripheral edge of a curvilinear score, the tear panel being configured for minimal resistence to opening with said surface area shape having a first portion and a second portion, said first portion having a surface area less than a surface area of the second portion, said first portion being located at the first side of the central axis and said second portion of the tear panel shape being located at the second side of the central axis.

13. The end closure of claim 12, wherein the tear panel has a surface area with the first portion of the tear panel having less of an extent of the surface area relative to the second portion of the tear panel.

14. The end closure of claim 12, wherein the tear panel has a generally tear-drop shape with a vent region adjacent the rivet, a narrow portion of the tear panel being defined by a score segment passing between the vent region and a radially outward area, and a wide portion of the tear panel defined by a score segment passing from the radially outward area to a hinge segment.

15. The end closure of claim 12, wherein the tear panel has a general egg-shape with the outermost segment of the score partially defining the second portion of the tear panel.

16. An end closure for a container, comprising:

a central panel wall having a product side and a public side and having a tab secured to said public side; said central panel having a central axis passing through a rivet and through a nose of the tab and an opposed lift-end of the tab;

a displaceable tear panel in the central panel wall, said tear panel being defined by a frangible score and a non-frangible hinge segment, said frangible score having an outer periphery defined by a curvilinear score cord length; said central longitudinal axis of the panel defining a 12:00–6:00 clockwise reference line for clockwise geometric orientation of said score outer periphery, the score having a radius of curvature in a 5:00 region along said orientation that is greater than a radius of curvature of the score in an 8:00 region of the score periphery.

17. The end closure of claim 16, wherein the radius of curvature of the score at the 5:00 region along said orientation is greater than the radius of curvature of the score at the 7:00 to 9:00 region of the orientation.

18. The end closure of claim 16, wherein the radius of curvature of the score at the 4:00 to 6:00 region is greater than the radius of curvature of the score at the 7:00 to 9:00 region of the orientation.

19. An end closure for a container, comprising:

a central panel wall having a product side and a public side and having a tab secured to said public side; said central panel having a central axis passing through a center of the rivet and through a nose of the tab and an opposed lift-end of the tab;

a displaceable tear panel in the central panel wall, said tear panel being defined by a frangible score and a non-frangible hinge segment, said frangible score having an outer periphery defined by a curvilinear score cord length; said central longitudinal axis of the panel defining a 12:00–6:00 clockwise reference line for clockwise geometric orientation of said score outer periphery, the score having an enlarged radius of curvature in a 4:00 to 5:00 region along said orientation that is larger than at least one radius of curvature along other portions of the score periphery along a length defined along a 6:00 to 9:00 orientation.

20. An end closure for a container, including a central panel wall having a product side and a public side and having a tab secured to said public side by a rivet; said central panel having a central longitudinal axis passing between a nose of the tab and an opposed lift-end of the tab, and being adapted to provide an opening force by the nose when a user lifts said lift end, a displaceable tear panel in the central panel wall, said tear panel being defined by a frangible score and a non-frangible hinge segment, said frangible score having a score residual adapted to fracture when subjected to said opening force by the tab nose, said fracture starting in a vent region of the tear panel and traveling radially outward form the vent region as the opening force is applied, said tear panel having an outer periphery defined by a curvilinear score cord length between said vent region and the hinge segment, the cord length having a first curved segment positioned adjacent the vent region, the score continuing to a second curved segment positioned radially outward of the first curved segment, and the score continuing to a third curved segment that directs the score generally radially inward on the central panel, the improvement comprising;

an enlarged radius of curvature at the second curved segment configured to provide mineral resistance to the fracture of the score by application of the opening force.

* * * * *

UNITED STATES PATENT AND TRADEMARK OFFICE

CERTIFICATE OF CORRECTION

PATENT NO. : 6,761,281 B2
DATED : July 13, 2004
INVENTOR(S) : Hartman

It is certified that error appears in the above-identified patent and that said Letters Patent is hereby corrected as shown below:

Column 4,
Line 63, delete “foaming” and insert -- forming --.

Column 5,
Line 12, delete “collected” and insert -- connected --.

Signed and Sealed this

Eighth Day of November, 2005

JON W. DUDAS
*Director of the United States Patent and Trademark Office*